United States Patent [19]

Powers et al.

[11] Patent Number: 4,869,426

[45] Date of Patent: Sep. 26, 1989

[54] DEVICE FOR IMPROVING ACCESSIBILITY

[76] Inventors: Elwood Powers, 825 Harper Dr., Algonquin, Ill. 60102; John W. Scudder, 113 Prairie, Apartment #4, Highwood, Ill. 60040

[21] Appl. No.: 186,009

[22] Filed: Apr. 25, 1988

[51] Int. Cl.[4] ..... B65D 91/00

[52] U.S. Cl. ..... 232/39

[58] Field of Search ..... 232/38, 39, 17; 248/298, 424, 429, 416, 417

[56] References Cited

U.S. PATENT DOCUMENTS

| | | |
|---|---|---|
| 827,929 | 8/1906 | Mellinger . |
| 898,487 | 9/1908 | Lanier . |
| 899,781 | 9/1908 | Anderson . |
| 902,974 | 11/1908 | Kouba . |
| 903,942 | 11/1908 | Thayer . |
| 911,935 | 2/1909 | Baumwart . |
| 964,295 | 7/1910 | Mills . |
| 969,965 | 9/1910 | Lillie . |
| 970,588 | 9/1910 | Wilfong . |
| 982,206 | 1/1911 | Hale . |
| 1,011,513 | 12/1911 | Spühl . |
| 1,033,874 | 7/1912 | Carpenter et al. . |
| 1,037,497 | 9/1912 | Lanier . |
| 1,037,498 | 9/1912 | Lanier . |
| 1,046,251 | 12/1912 | Bell . |
| 1,053,082 | 2/1913 | Yeakel . |
| 1,139,491 | 5/1915 | Coon . |
| 1,430,476 | 9/1922 | Trekell . |
| 1,467,607 | 9/1923 | Cook . |
| 1,494,181 | 5/1924 | Morris . |
| 1,531,677 | 3/1925 | Miller . |
| 1,533,956 | 4/1925 | Thornton . |
| 1,545,006 | 7/1925 | Miller . |
| 1,667,639 | 4/1928 | Smith . |
| 1,731,682 | 10/1929 | Pendergrass . |
| 1,888,119 | 11/1932 | Fuller . |
| 1,992,640 | 2/1935 | Steen . |
| 2,420,699 | 5/1947 | Cox . |
| 2,723,098 | 11/1955 | Moore ..... 232/39 X |
| 2,781,964 | 2/1988 | Ledgerwood . |
| 3,163,356 | 12/1964 | Joehnk . |
| 3,205,025 | 9/1965 | Jordan . |
| 3,497,078 | 2/1970 | Nash . |
| 3,593,914 | 7/1971 | Vas Orden . |
| 3,606,140 | 9/1971 | Shannahan . |
| 3,771,849 | 11/1973 | Barber . |
| 3,778,125 | 12/1973 | Gutmann, Jr. et al. . |
| 3,827,626 | 8/1974 | Daigle . |
| 4,113,213 | 9/1978 | Gay et al. . |
| 4,264,032 | 4/1981 | Vanis . |
| 4,714,192 | 12/1987 | Harlow, Jr. et al. . |

*Primary Examiner*—Robert W. Gibson, Jr.
*Attorney, Agent, or Firm*—Mathew R. P. Perrone, Jr.

[57] ABSTRACT

A device for supporting a container or a mailbox improves accessibility by providing for a mailbox or other container from a first position to a second position of up to one and one-half times or more beyond the first position.

21 Claims, 2 Drawing Sheets

DEVICE FOR IMPROVING ACCESSIBILITY

BACKGROUND OF THE INVENTION

This invention relates to a device for improving accessibility to a container, and more particularly to a device for mounting a mailbox, which improves the mailbox accessibility. The device is also suitable for providing controlled access to a secure area.

It is well known that a substantial number of Federal regulations apply to the mounting and accessibility of the mailboxes of the type which are mounted on a post adjacent the edge of the road. A mailbox must be mounted at a certain height and within a certain distance of the road. It must be mounted firmly and must be accessible to the person delivering the mail for the United States Postal Service and to the person receiving the mail.

With regard to accessibility, many factors can cause problems. Snow may be piled up by the mailbox. Rain may also expose the mailbox to weather and require that the person using the mailbox be exposed to the elements. It is highly desirable to avoid such exposure to the elements. Yet avoiding exposure to the elements while maintaining the accessibility to the mailbox require conflicting situations. If exposure to the elements is a prime goal, sacrifices must usually be made in the accessibility. If accessibility is a prime goal, sacrifices with regard to exposure to the elements must be made.

This problem has been addressed many times in the prior art. Various spring and tray devices are known. These devices however tend to lose their ability to function while at the same time requiring exposure to the elements to permit accessibility thereto and use thereof.

Typical of other uses for a device which can provide good accessibility to mailbox is in secure areas. There are many secure areas for various reasons. One type of secure area involves national security. Another secure area might be near a nuclear facility. Also a bank prefers a certain amount of security. If access to these secure areas can be simplified, while maintaining the security, great advantages are achieved.

It is thus highly desirable to provide a device which improves accessibility to the mailbox or other secure areas without either requiring a major sacrifice or exposure to the elements, or compromising the security of the area.

SUMMARY OF THE INVENTION

Accordingly, among the many objects of this invention is to provide a device which provides accessibility to a mailbox.

A further object of this invention is to provide a device which provides accessibility to a mailbox while avoiding exposure to the elements.

A still further object of this invention is to provide a durable device for providing accessibility to a mailbox.

Yet a further object of this invention is to provide a device for providing accessibility to a mailbox which does not interfere with the functions of a mailbox.

Also an object of this invention is to provide a device for providing accessibility to a secure area, which does not compromise the security thereof.

Another object of this invention is to provide a device for providing accessibility to a bank, which does not compromise the security thereof.

Yet another object of this invention is to provide a device for providing accessibility to a nuclear facility, which does not compromise the security thereof.

These and other objects (which other objects become clear by consideration of the specification, drawings and claims as a whole) of the invention are met by providing a powered, electrical device for extending mailbox or other container on a given signal as desired. A series of devices may be activated by both a common signal to be used by the Post Office. A separate device used by the homeowner has its unique signal different from that of the Post Office to operate the device. In the event of the device being used in a secure area, appropriate adjustments are made.

BRIEF DESCRIPTION OF THE DRAWINGS

Throughout the Figures of drawings where the same part appears in more than one Figure of the drawings, the same numeral is applied thereto.

DESCRIPTION OF THE PREFERRED EMBODIMENTS

A standard mailbox customarily used in the rural sections of the United States or in areas served by a motorized postal delivery person is supported on a motor box support assembly. The motor box support assembly permits moving of the mailbox outwardly from the post on which the box is mounted so that the mailbox can be reached easily by the delivery person or by the owner. This structure permits the mailbox to be set back from the road or to be made more accessible in the event of snow. The mailbox is extended when it is desired to insert or remove mail and retracted when it is not so desired. The mailbox may even be extended right into the car. Another container, besides a mailbox may be used with this device. This device is also suitable for use in providing simplified, but controlled access to a secured area.

Figure 1:
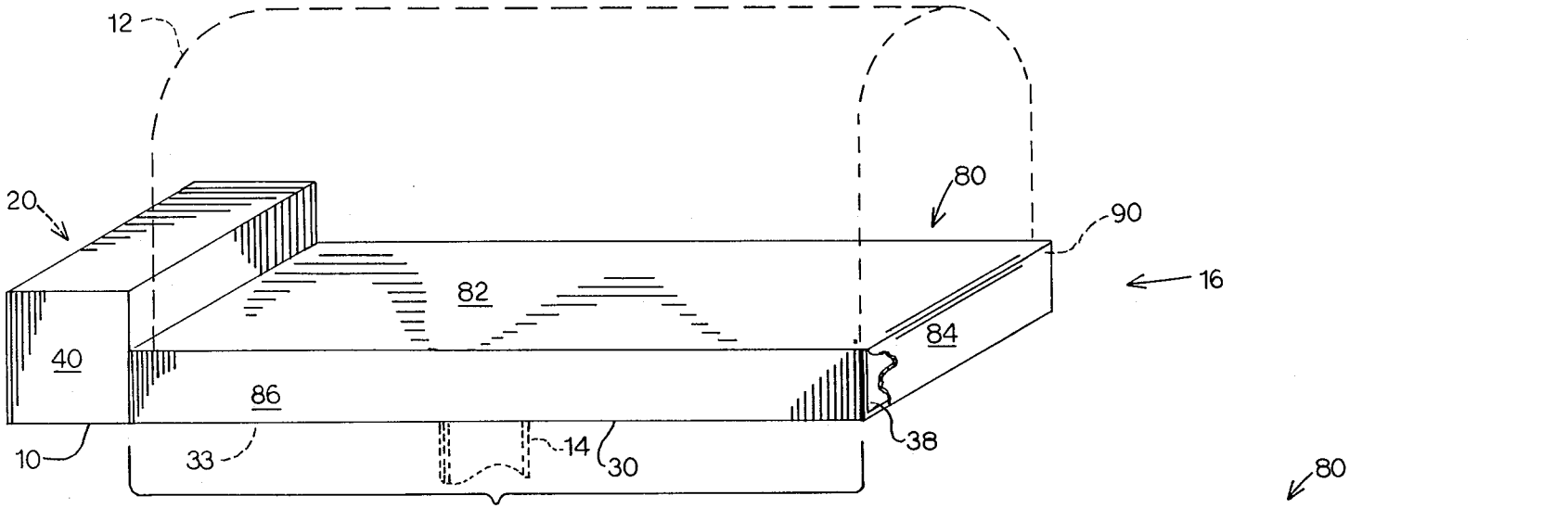
FIG. 1 depicts a perspective view of the accessibility device of this invention used as a motorized mailbox mount 10 showing mailbox 12 thereon in closed position 16.

Referring now to FIG. 1, a motor box support assembly 10 supports thereon a mailbox 12 and with the entire unit supported by a post 14. The post 14 or other suitable mounting device is standard for a mailbox of the type of mailbox 12. The motor box support assembly 10 includes a housing 20 having at one end thereof a motor housing 40 supported on a base 30. Additionally supported on base 30 is a support plate 80. Support plate 80 receives and supports mailbox 12. FIG. 1 depicts mailbox support assembly 10 in a closed position 16.

Figure 2:
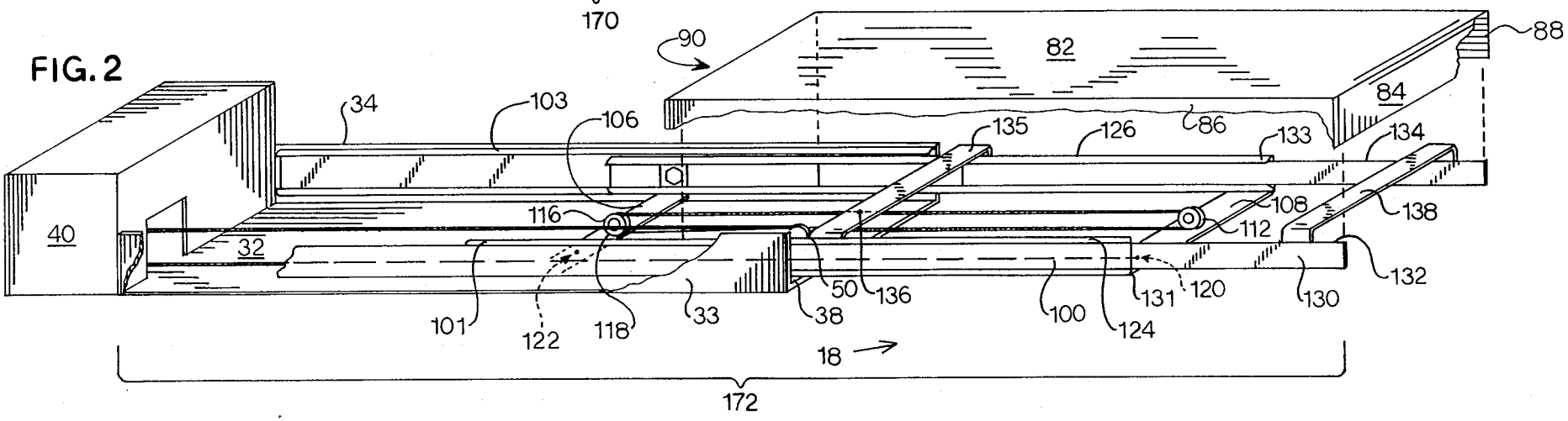
FIG. 2 depicts a perspective, partially-exploded view of the accessibility device of this invention used as a motorized mailbox mount 10 in open position 18.

Referring now to FIG. 1 and FIG. 2, base 30 includes a base plate 32 on a bottom side thereof. Substantially perpendicular to base plate 32 are a first base side 33 at an edge of base plate 32 and a second base side 34 at the opposing edge of base plate 32 for the base 30. Due to the cooperation between plate 32 and first base side 33 and second base side 34, a lower channel 38 is formed to receive a first slide assembly 100 (shown in FIG. 2) and a second slide assembly 130.

Support plate 80 is shown as having a box holder 82 which amounts substantially parallel to base plate 32 of base 30. Plate flange 84 is substantially perpendicular to box holder 82 and serves to close and protect first slide assembly 100 and second slide assembly 130. First plate side 86 is perpendicular to both plate flange 84 and box holder 82. In closed position 16, first plate side 86 is parallel to first base side 33 and outside of lower channel 38.

Second plate side 88 is also perpendicular to both plate flange 84 and box holder 82. In closed position 16, second plate side 88 is parallel to second base side 34 and outside of channel 38. If follows that second plate side 88 is parallel to first plate side 86. Due to the cooperation between second plate side 88, first plate side 86, plate flange 84, and box holder 82; support plate 80 forms an upper channel 90. Upper channel 90 receives lower channel 38 therein, when closed position 16 is assumed.

FIG. 2 depicts motor box support assembly 10 in an open position 18 with support plate 80 removed to more clearly show the structure of first slide assembly 100 and second slide assembly 130. Basically both first slide assembly 100 and second slide assembly 130 are described in U.S. Pat. No. 3,205,025 to Fred A. Jordan. First slide assembly 100 fits directly in lower channel 38. Second slide assembly 130 fits inside of first slide assembly 100. A third slide assembly may be fitted within second slide assembly 130, to provide for even greater extension.

The combination of first slide assembly 100 and second slide assembly 130 permit a great advantage in this particular structure, because motor box support assembly 10 permits an extension of up to one and one-half (1.5) times from the closed position 16. For example, if first slide assembly 100 and second slide assembly 130 have a length of forty (40) centimeters, the closed distance 170 (shown in FIG. 1) is forty (40) centimeters. At the maximum of open distance 172 (shown in FIG. 2), the extension of motor box support assembly 10 may be up to one hundred (100) centimeters.

If an additional slide assembly is added to the combination of first slide assembly 100 and second slide assembly 130 an extension of up to two and one-quarter (2.25) times from the closed position 16. For example, if the additional slide assembly combined with first slide assembly 100 and second slide assembly 130 have a length of forty (40) centimeters, the extension of motor box support assembly 10 may be up to one hundred thirty (130) centimeters. The additional slide assembly is mounted to the second slide assembly 130 in the same fashion that the second slide assembly 130 is mounted to first slide assembly 100. While the structure of the third slide assembly is not shown in the drawing, the structure thereof becomes clear in view of the overall disclosure herein—thereby rendering a drawing figure thereon superfluous.

Figure 3:
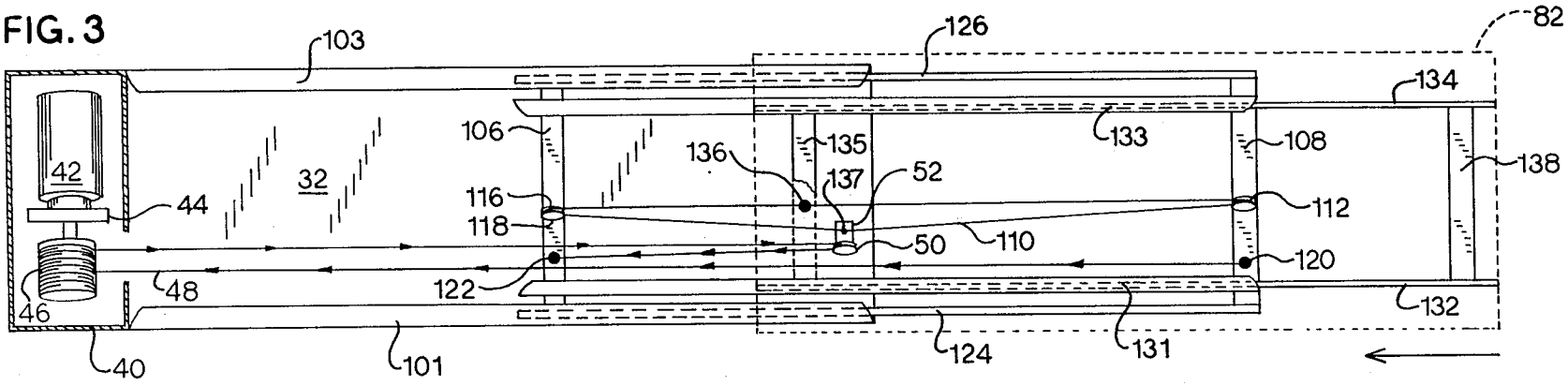
FIG. 3 depicts a top view of the accessibility device of this invention used as a motorized mailbox mount 10 in open position 18 with support plate 80 removed and motor box 40 depicted.

Referring now to FIG. 2 and FIG. 3, motor housing 40 is seen as containing motor 42. Motor 42 is operably connected to a reduction box 44 which in turn is operably connected to wire reel 46 which receives and takes up drive wire 48. With the activation of motor 42, drive wire 48 serves to extend motor box support assembly 10 to open position 18 or return motor box support assembly 10 to closed position 16. Motor 42 is mounted in a suitable fashion within motor housing 40. Gear reduction box 44 is mounted in motor housing 40 also and connected to the motor 42 in a standaard fashion. Likewise, wire reel 46 is connected to the gear reduction box 44 in a standard fashion. Gear reduction box 44 slows the speed of motor 42 to operate wire reel 46 suitably.

Operably connected to wire reel 46 to be wrapped therearound is drive wire 48. Drive wire 48 also passes around drive pulley 50. Drive pulley 50 is secured within lower channel 38 by drive pulley bracket 52. Of course, drive pulley 50 is secured in lower channel 38 and is oppositely disposed from motor housing 40. Drive wire 48 is secured to first slide assembly 100. Forward drive wire mount 120 is secured at the other end thereof to rear drive wire mount 122. Drive wire 48 passes from rear wire mount 122 over drive pulley 50 to reel 46 and then to forward drive wire mount 120.

Forward drive wire mount 120 is situated on second pulley bar 108. Rear drive wire mount 122 is situated on first pulley bar 106. Thus, first pulley bar 106 and second pulley bar 108 provide strength to support the positioning of first movable bar 125 and second movable bar 126. This strength adds durability to the entire device 10.

First slide assembly 100 is mounted in lower channel 38. First slide assembly 100 includes first outer slide 101 adjacent to first base side 33. First outer slide 101 is secured first base side 33 by welding, bolting or other suitable devices. Second outer slide 103 is oppositely disposed from first outer slide 101 and is adjacent the second base side 34. Second outer slide 103 is also secured to second base side 34 by welding, bolting or other suitable fastening devices.

Slideably and movably secured in a horizontal fashion within first outer slide 101 is first movable bar 124. First movable bar 124 is bearing supported in a standard fashion within first outer slide 101. In a similar fashion, slideably and movably secured in a horizontal fashion within second outer slide 103 is second movable bar 126. Similar to first movable bar 124, second movable bar 126 is bearing supported in a standard fashion within second outer slide 103.

First movable bar 124 and second movable bar 126 are supported in relation to lower channel 38 and each other by first pulley bar 106 and second pulley bar 108. First pulley bar 106 is adjacent motor housing 40 when mailbox support assembly 10 is in closed position 16. Second pulley bar 108 is adjacent plate flange 84 when motor box support assembly 10 is in closed position 16. First pulley bar 106 and second pulley bar support 108 provide support to hold first slide assembly 100 in lower channel 38.

Second slide assembly 130 includes a first inner slide 311 adjacent and secured to first movable bar 124, and a second inner slide 133 is adjacent and secured to second movable bar 126. Supporting first inner slide 131 and second inner slide 133 in relation to each other are first pulley bar 106 and second pulley bar 108.

Slideably and movably secured in a horizontal fashion within first inner slide 131 is first movable bar 132. First movable bar 132 is bearing supported in a standard fashion—usually as described in U.S. Pat. No. 3,205,025 to Fred A. Jordan as above referenced—within first inner slide 131. In a similar fashion, slideably and movably secured in a horizontal fashion within second inner slide 133 is second movable bar 134. Similar to first movable bar 132, second movable bar 134 is bearing supported within second inner slide 133 in a standard fashion.

First movable bar 132 is secured to second movable bar 134 by first fixed bar 135 and second fixed bar 138. First fixed bar 135 is generally adjacent to second pulley bar 108 when motor box support assembly 10 is in open position 18 with open position 18 being extended as far as possible. First fixed bar 135 is adjacent motor housing 40 when the motor box support assembly 10 is in closed position. Second fixed bar 138 is substantially always adjacent plate flange 84.

It is first fixed bar 135 and second fixed bar 138 that support box holder 82. First fixed bar 135 has fixed wire 110 secured thereto by bolting, welding or other suitable means. Fixed wire 110 is secured at the first end thereof to fixed bar 135 at first anchor 136 thereon. The second and opposing end of fixed wire 110 is secured to pulley bracket 52 at second anchor 137 thereon.

On second pulley bar 108 is mounted a forward pulley 112 around which fixed wire 110 passes. Fixed wire 110 also passes around rear pulley 116 which has a rear pulley bracket 118 mounted in a secure fashion by bolting or welding on first pulley bar 106. As wire reel 46 rotates, movable drive wire 48 moves and forces first outer movable bar 124 of first slide assembly 100 out of lower channel 38. Forward pulley 112 is secured to first movable bar 124 and second movable bar 126 through pulley bar 108 in any standard fashion. Forward pulley 112 pushes against fixed wire 110.

Fixed wire 110 is secured to second anchor 137 positioned at a front portion of lower channel 38 and forces first inner movable bar 132 and second inner movable bar 134 of second slide assembly 130 out of first slide assembly 100 due to its fixed point at first anchor 136. This function occurs as extension proceeds. When mailbox 12 retracts to its normal position, the functions occur but for the exertion of force through rear pulley 116. These functions occur when motor 42 can be activated in a suitable fashion—for example, electrically by direct electrical connection, or by radio sending device similar to that used in a garage door opener.

Figure 4:
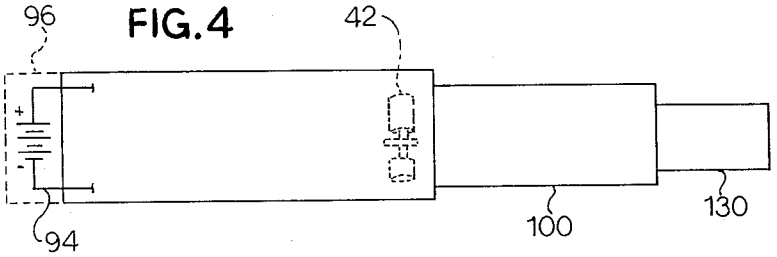
FIG. 4 depicts a bottom view of FIG. 3 with motor box 40 removed, and motor 42 having a forward position.

Referring now to FIG. 4, it becomes possible to eliminate motor housing 40 and place the motor 42 within lower channel 38 at the location of drive pulley 50. In this fashion, drive pulley 50 is replaced by wire reel 46 and permits for simpler take up of the structure. Motor 42 can be placed and secured inside the second slide assembly 130 in view of the one and three-quarters (1.75) extension of each of second slide assembly 130 and first slide assembly 100. Likewise, this particular structure permits motor housing 40 to be used as a battery housing so that there is a battery support for a battery pack instead of a direct electrical connection to AC current.

Figure 5:
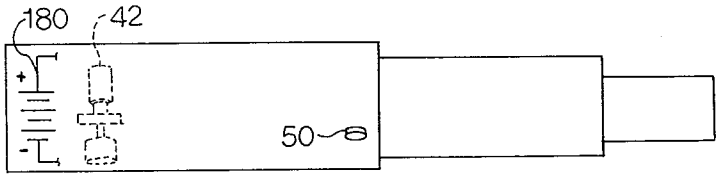
FIG. 5 depicts a bottom view of FIG. 3 with motor box 40 removed, and motor 42 having a rear position.

Referring now to FIG. 5, another suitable position, without motor housing 40 is shown for motor 42 within lower channel 38 at the rear of base 30. In this fashion, drive pulley 50 is still required, but simpler take up of the structure is still possible due to the absence of motor housing 40.

Referring now to FIG. 4 and FIG. 5, motor 42 can be placed and secured inside the second slide assembly 130. Likewise, this particular structure permits motor housing 40 to be used as a battery housing so that there is a battery support 96 for a battery pack 94 instead of direct electrical connection to AC current. Also the battery pack 94 may be placed appropriately inside second slide assembly 130, with motor housing 40 eliminated completely. Furthermore, it is possible to place battery pack 94 and have it secured in a standard fashion to base 30 in lower channel 38 as shown, when motor 42 is at the rear of base 30. Battery pack 94 and motor 42 may also have their positions reversed. Both motor 42 and battery 180 are within second slide assembly 130.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modifications of this apparatus can become clear to a person having ordinary skill in this particular art. Such modifications are clearly protected by this disclosure.

What is claimed and sought to be protected by Letters Patent of the United States is:

We claim:

1. A device for moving a container from a first position to at least one second position, wherein:

a. said device includes a housing;
b. an extending means and a power source for operating said device are secured to said housing;
c. said container is secured to said extending means;
d. a signal means is operable connected to said power source to provide for a selection of an operating time for said device; and
e. said first position includes an extension length for moving said container outwardly to said at least one second position up to a factor of 1.5 beyond said first position.

2. The device for moving a container of claim 1, wherein a. said housing has an upper member and a lower member;
b. said extending means includes an extension assembly;
c. said lower member contains said extension assembly;
d. said upper member supports said container; and
e. said lower member includes a channel to contain said extension assembly.

3. The device for moving a container of claim 2, wherein:

a. said extension assembly includes a first slide assembly and a second slide assembly;
b. said first slide assembly includes a first outer slide and a second outer slide oppositely disposed from said first outer slide;
c. a first movable bar is slideably and movably secured in a horizontal fashion within said first outer slide;
d. a second movable bar is slideably and movably secured in a horizontal fashion within said second outer slide;
e. a first pulley bar joins and supports said first movable bar and said second movable bar at a rear portion of said housing; and
f. a second pulley bar joins and supports said first movable bar and said second movable bar at a forward portion of said housing.

4. The device for moving a container of claim 3, wherein:

a. said extension assembly includes said second slide assembly secured inside said first slide assembly;
b. said second slide assembly includes a first inner slide adjacent to and secured to said first movable bar;
c. said second slide assembly includes a second inner slide adjacent to and secured to second movable bar; and
d. a drive wire assembly is mounted in said channel for operating said first slide assembly and aid second slide assembly.

5. The device for moving a container of claim 4, wherein:
a. said drive wire assembly includes a powered wire reel, a drive wire received by said powered wire reel, a drive pulley, a first drive wire securing means and a second drive wire securing means;
b. said powered wire reel is secured in a rear portion of said housing;
c. said drive pulley is secured at forward portion of said housing;
d. said first drive wire securing means is mounted on said first pulley bar and secures a first end of said drive wire;
e. said second drive wire securing means is mounted on said second pulley bar and secures a second end of said drive wire; and
f. said drive wire passes over said drive pulley and said powered wire reel.

6. The device for moving a container of claim 5, wherein:
a. a fixed wire assembly cooperates with said drive wire assembly;
b. said fixed wire assembly includes a rear fixed wire segment, a forward fixed wire segment, a forward fixed wire pulley, and a rear fixed wire pulley;
c. a first, forward, fixed wire segment end is secured to a first fixed bar;
d. a second, forward, fixed wire segment end is secured to a wire holder;
e. a first, rear, fixed wire segment end is secured to said first fixed bar;
f. a second, rear, fixed wire segment end is secured to said wire holder;
g. said rear fixed wire segment passes over said rear fixed wire pulley; and
h. said forward fixed wire segment passes over said forward fixed wire pulley.

7. The device for moving a container of claim 6, wherein:
a. said first fixed bar joins said first movable bar to said second movable bar;
b. said second fixed bar joins said first movable bar to said second movable bar;
c. said first fixed bar is generally adjacent a rear portion of said housing from said closed position; and
d. said second fixed bar is oppositely disposed bar from said first fixed bar.

8. The device for moving a container of claim 1, wherein:
a. said extending means includes a wire reel to serve as a drive pulley; and
b. an electric motor drives said wire reel.

9. The device for moving a container of claim 1, wherein an electric motor is secured in a channel of said housing and provides power for a wire reel.

10. The device for moving a container of claim 1, wherein said housing further includes a motor housing to contain a wire reel and a power source for said wire reel.

11. The device for moving a container of claim 1, wherein said housing further includes a battery housing for housing a battery system to power said device.

12. The device for moving a container of claim 1, wherein:
a. a lower member for said housing includes a base plate on a bottom side thereof;
b. a first base side is at an edge of said base plate and a second base side is at an opposing edge of said base plate to form said base;
c. said base plate, first base side, and said second base side cooperate to form a lower channel; and
d said lower channel receives a first slide assembly and a second slide assembly.

13. The device for moving a container of claim 1, wherein:
a. an upper member for said housing includes a support plate on a top side thereof;
b. said support plate includes a container support, which mounts substantially parallel to said base plate;
c. said support plate includes a plate flange substantially perpendicular to said container support;
d. a first plate side is perpendicular to both said plate flange and said container support at a first edge of said container support;
e. a second plate side is perpendicular to both said plate flange and said container support at a second edge of said container support and oppositely disposed from said first plate side;
f. said second plate side, said plate flange, said container support said first plate side to form an upper channel;
g. said upper channel receives said lower channel when said device is in a closed position.

14. A device for moving a container from a first position to at least one second position, wherein:
a. said device includes a housing;
b. an extension assembly and a power source for operating said device are secured to said housing;
c. said container is secured to said extension assembly at an extending means within said extension assembly;
d. a signal means is operably connected to said power source to provide for a selection of an operating time for said device;
e. said first position includes an extension length for moving said container outwardly to said at least one second position up to a factor of 1.5 beyond said first position;
f. said housing has an upper member and a lower member;
g. said lower member contains said extension assembly;
h. said upper member supports said container;
i. said lower member includes a channel to contain said extension assembly;
j. said extension assembly includes a first slide assembly and a second slide assembly;
k. said first slide assembly includes a first outer slide and a second outer slide oppositely disposed from said first outer slide;
l. a first movable bar is slideably and movably secured in a horizontal fashion within said first outer slide;

m. a second movable bar is slideably and movably secured in a horizontal fashion within said second outer slide;

n. a first pulley bar joins and supports said first movable bar and said second movable bar at a rear portion of said housing; and o. a second pulley bar joins and supports said first movable bar and said second movable bar at a forward portion of said housing.

15. The device for moving a container of claim 14, wherein:

a. said extension assembly includes said first slide assembly secured inside said second slide assembly;

b. said second slide assembly includes a first inner slide adjacent to and secured to said first movable bar;

c. said second slide assembly includes a second inner slide adjacent to and secured to second movable bar;

d. a drive wire assembly is mounted in said channel for operating said first slide assembly and said second slide assembly;

e. said drive wire assembly includes a powered wire reel, a drive wire received by said powered wire reel, a drive pulley, a first drive wire securing means and a second drive wire securing means;

f. said powered wire reel is secured in a rear portion of said housing;

g. said drive pulley is secured at forward portion of said housing;

h. said first drive wire securing means is mounted on said first pulley bar and secures a first end of said drive wire;

i. said second drive wire securing means is mounted on said second pulley bar and secures a second end of said drive wire;

j. said drive wire passes over said drive pulley and said powered wire reel;

k. a fixed wire assembly cooperates with said drive wire assembly;

l. said fixed wire assembly includes a rear fixed wire segment, a forward fixed wire segment, a forward fixed wire pulley, and a rear fixed wire pulley;

m. a first, forward, fixed wire segment end is secured to a first fixed bar;

n. a second, forward, fixed wire segment end is secured to a wire holder;

o. a first, rear, fixed wire segment end is secured to said first fixed bar;

p. a second, rear, fixed wire segment end is secured to said wire holder;

q. said rear fixed wire segment passes over said rear fixed wire pulley; and r. said forward fixed wire segment passes over said forward fixed wire pulley.

16. The device for moving a container of claim 15, wherein:

a. said first fixed bar joins said first movable bar to said second movable bar;

b. said second fixed bar joins said first movable bar to said second movable bar;

c. said first fixed bar is generally adjacent a rear portin of said housing from said closed position; and d. said second fixed bar is oppositely disposed from said first fixed bar.

17. The device for moving a container of claim 16, wherein:

a. said wire reel serves as a drive pulley; and b. an electric motor drives said wire reel.

18. The device for moving a container of claim 17, wherein said housing further includes a motor housing to support said wire reel and a power source therefore.

19. The device for moving a container of claim 17, wherein said housing further includes a battery housing or housing a battery system to power said device.

20. A device for moving a container from a first position to at least one second position, wherein:

a. said device includes a housing;

b. an extending means and a power source for operating said device are secured to said housing;

c. said container is secured to said extending means;

d. a signal means is operably connected to said power source to provide for a selection of an operating time for said device;

e. said first position includes an extension length for moving said container outwardly to said at least one second position up to a factor of 1.5 beyond said first position;

f. a lower member for said housing includes a base plate on a bottom side thereof;

g. a first base side is at an edge of said base plate and a second base side is at an opening edge of said base plate to form said base;

h. said base plate, first base side, and said second base side cooperate to form a lower channel; and i. said lower channel receives a first slide assembly and a second slide assembly.

21. The device for moving a container of claim 20, wherein:

a. an upper member for said housing includes a support plate on a top side thereof;

b. said support plate includes a container support, which mounts substantially parallel to said base plate;

c. said support plate includes a plate flange substantially perpendicular to said container support; d. a first plate side is perpendicular to both said plate flange and said container support at a first edge of said container support;

e. a second plate side is perpendicular to both said plate flange and said container support at a second edge of said container support and oppositely disposed from said first plate side;

f. said second plate side, said plate flange, said container support said first plate side to form an upper channel; and g. said upper channel receives said lower channel when said device is in a closed position.

* * * * *